US006413466B1

(12) United States Patent
Boyd et al.

(10) Patent No.: US 6,413,466 B1
(45) Date of Patent: Jul. 2, 2002

(54) PLASTIC CONTAINER HAVING GEOMETRY MINIMIZING SPHERULITIC CRYSTALLIZATION BELOW THE FINISH AND METHOD

(75) Inventors: Timothy J. Boyd, Ypsilanti; Kerry W. Silvers, Chelsea, both of MI (US)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/609,601

(22) Filed: Jun. 30, 2000

(51) Int. Cl.[7] ..... B29C 49/00
(52) U.S. Cl. ..... 264/523; 264/900
(58) Field of Search ..... 264/523, 900

(56) References Cited

U.S. PATENT DOCUMENTS

| | | | | |
|---|---|---|---|---|
| 4,039,641 A | | 8/1977 | Collins | |
| 4,091,059 A | | 5/1978 | Ryder | |
| 4,151,250 A | | 4/1979 | Barry et al. | |
| 4,154,920 A | | 5/1979 | Jabarin | |
| 4,244,913 A | | 1/1981 | Ryder | |
| 4,264,558 A | | 4/1981 | Jacobsen | |
| 4,385,089 A | | 5/1983 | Bonnebat et al. | |
| 4,476,170 A | | 10/1984 | Jabarin | |
| 4,497,855 A | * | 2/1985 | Agrawal et al. | 428/35 |
| 4,512,948 A | | 4/1985 | Jabarin | |
| 4,522,779 A | | 6/1985 | Jabarin | |
| 4,790,741 A | | 12/1988 | Takakusaki et al. | |
| 4,850,850 A | | 7/1989 | Takaausaki et al. | |
| 4,863,046 A | | 9/1989 | Collette et al. | |
| 4,883,631 A | | 11/1989 | Ajmera | |
| 4,889,247 A | * | 12/1989 | Collette et al. | 215/1 C |
| 5,261,454 A | | 11/1993 | Ota | |
| 5,265,743 A | * | 11/1993 | Frohn | 215/10 |
| 5,908,128 A | | 6/1999 | Krishnakumar et al. | |

FOREIGN PATENT DOCUMENTS

WO WO 96/30190 10/1996

OTHER PUBLICATIONS

The Crystallization of Oriented Poly(ethyleneterephthalate), F.S. Smith and R.D. Steward, CI Fibres, Hookstone Road, Harrogate, Yorkshire HG2 8QN, UK, Received May 15, 1973; revised Jun. 26, 1973.

The Crystallization of Poly(ethyleneterephthalate) and Related Copolymers, J.B. Jackson and F. W. Longman, Paper Presented at the SPE 27$^{th}$ Annual Technical Conference, Chicago, May 1969.

Crystallization and Thermal Stabilization of Heat Set PET, S.A. Jabarin, accepted for publication in the Polymeric Materials Encyclopedia.

* cited by examiner

*Primary Examiner*—Suzanne E. McDowell
(74) *Attorney, Agent, or Firm*—Harness, Dickey & Pierce, P.L.C.

(57) ABSTRACT

A plastic container for retaining a commodity during a high temperature pasteurization or retort process. The container includes a finish defining an aperture for receiving the commodity, a body portion generally extending downward from the finish portion, and a base portion generally extending inward from the body portion and closing off the bottom of the container. The body portion itself includes a sidewall having a crystallinity of greater than 30% and a shoulder portion flaring outward, from a generally transverse plane defined by the mouth of the container, at an angle of about 15° or less.

14 Claims, 2 Drawing Sheets

PLASTIC CONTAINER HAVING GEOMETRY MINIMIZING SPHERULITIC CRYSTALLIZATION BELOW THE FINISH AND METHOD

TECHNICAL FIELD OF THE INVENTION

This invention generally relates to plastic containers for retaining a commodity during a pasteurization or retort process. More specifically, this invention relates to plastic containers having a shoulder geometry that minimizes spherulitic crystallization below the finish during subsequent thermal processing of the container and/or a product within the container and a method for manufacturing a like container.

BACKGROUND

Numerous commodities previously supplied in glass containers are now being supplied in plastic, more specifically polyester and even more specifically polyethylene terephthalate (PET), containers. The manufacturers and fillers, as well as consumers, have recognized that PET containers are lightweight, inexpensive, recyclable, and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is utilized to sterilize the container at the time of filling. This process and the containers designed to withstand it are respectively known as hot filling and hot fill or heat set containers. Hot filling works as an acceptable process with commodities having a high acid content. Non-high acid commodities, however, must be processed in a different manner and manufacturers and fillers also desire to supply PET containers for those commodities.

For non-high acid commodities, pasteurization and retort are the preferred sterilization methods. Pasteurization and retort both presents an enormous challenge for manufactures of PET containers in that heat set containers cannot withstand the temperature and time demands of pasteurization and retort.

Pasteurization and retort are both methods for cooking or sterilizing the contents of a container after it has been filled. Both processes include the heating of the contents of the container to a specified temperature, usually above about 70° C. (about 155° F.), for a specified length of time (20–60 minutes). Retort differs from pasteurization in that higher temperatures are used, as is an application of pressure externally to the container. The pressure is necessary because a hot water bath is often used and the overpressure keeps the water, as well as liquid in the product, in liquid form above its boiling point temperature.

These processes present technical challenges for manufactures of PET containers, since new pasteurizable and retortable PET containers for these commodities will have to perform above and beyond the current capabilities of conventional heat set containers. Quite simply, the PET containers of the current techniques in the art cannot be produced in an economical manner such that they maintain their material integrity during the thermal processing of pasteurization and retort.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. Crystallinity is characterized as a volume fraction by the equation:

$$\text{Crystallinity} = \frac{\rho - \rho_a}{\rho_c - \rho_a}$$

where $\rho$ is the density of the PET material; $\rho_a$ is the density of pure amorphous PET material (1.333 g/cc); and $\rho_c$ is the density of pure crystalline material (1.455 g/cc).

The crystallinity of a PET container can be increased by mechanical processing and by thermal processing.

Mechanical processing involves orienting the amorphous material to achieve strain hardening. This processing commonly involves stretching a PET container along a longitudinal axis and expanding the PET container along a transverse or radial axis. The combination promotes what is known as biaxial orientation in the container. Manufacturers of PET bottles currently use mechanical processing to produce PET bottles having about 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque (and generally undesirable). Used after mechanical processing, however, thermal processing results in higher crystallinity and excellent clarity. The thermal processing of an oriented PET container, which is known as heat setting, typically includes blow molding a PET preform against a mold heated to a temperature of about 120° C.–130° C. (about 100° F.–105° F.), and holding the blown container for about 3 seconds. Manufacturers of PET juice bottles, which must be hot filled at about 85° C., currently use heat setting to produce PET bottles having a crystallinity range of 25–30%. Although heat set PET bottles perform adequately during hot fill processes, they are inadequate to withstand a pasteurization or retort process.

It should be noted that as the term is used herein, pasteurization is referring to pasteurization processes where pasteurization of the commodity occurs within the container. Also, a distinction needs to be made between pasteurization temperatures of the commodity internally of the container verses those temperatures applied exteriorly of the container to achieve the desired internal commodity temperature. Unless otherwise indicated, the pasteurization temperatures referenced herein will refer to the external temperatures applied to the container in order to achieve pasteurization of the contents within the container.

A further distinction needs to be made between the pasteurization of liquids and the pasteurization of solid commodities (herein those commodities containing a portion of solids, e.g. pickles), both of which generally require an internal pasteurization temperature of about 750° C. (about 168° F.). In the pasteurization of liquid commodities, pasteurization temperatures of about 68° C.–79° C. (about 155° F.–175° F.) are required to achieve the desired internal pasteurization temperature. Pasteurization of this variety is herein referred to as low temperature pasteurization.

In the pasteurization of solid commodities, pasteurization temperatures of about 82° C.–99° C. (about 180° F.–210° F.) are required to achieve the desired internal pasteurization temperature, within generally the same amount of time. This is because of the lower thermal conductivity of the solid portions of the commodity. Pasteurization of this variety, where the pasteurization temperature is above 79° C. (175° F.) (the glass transition temperature of PET), is herein referred to as high temperature pasteurization.

For completeness, retort processes typically involves internal retort temperatures of 104° C.–121° C. (220° F.–250° F.) and external retort temperatures of 104° C.–132° C. (220° F.–270° F.). Unless specified otherwise, as used herein retort temperatures will be referring to external retort temperatures.

Since conventional heat set PET containers cannot withstand high temperature pasteurization and retort processing, the manufacturers of PET containers desire to produce a PET container that maintains aesthetic and material integrity during any subsequent high temperature pasteurization or retort of the contents in the PET container.

It is therefore an object of this invention to provide such a container that overcomes the problems and disadvantages of the conventional techniques in the art.

An object of this invention is therefore to provide a container capable of being subjected to high temperature pasteurization and retort while maintaining its aesthetic and material integrity.

Another object of this invention is to provide a container having high crystallinity levels (greater than 30%) in its sidewalls and clarity in the body of the container, from immediately below the support ring of the container to at least the base of the container.

SUMMARY OF THE INVENTION

Accordingly, this invention provides for a plastic container which maintains aesthetic and material integrity during any subsequent high temperature pasteurization or retort process, and during subsequent shipment and use.

Briefly, the plastic container of the invention includes a finish, a body portion and a base portion. The finish includes an opening defining the mouth of the container, a threaded portion (or other configuration) as a means to engage a closure, and a support ring that is used during handling, both before and during and after manufacturing. The body portion includes a shoulder and a sidewall. The sidewall generally defines the greatest portion of the container's diameter. The shoulder is that transition portion from just below the support ring to the sidewall. Both the shoulder and sidewall are provided with a high crystallinity, a crystallinity of greater than 30%. Relative to a generally transverse plane defined by the mouth of the container, the shoulder of a container according to the present invention flares outward from the finish at an angle of about 15° or less, more preferably 10° or less, and most preferably at about an angle of zero. By flaring outward at such a drastic or sharp angle, the PET material which defines the transition from unoriented to oriented material is restricted to the finish and moved out from the shoulder. As a result, during the thermal processing of the container which induces high crystallinity, as well as during the high temperatures and long duration of high temperature pasteurization and retort processes, the shoulder portion of the present container does not opacify and remain aesthetically acceptable.

Accordingly, in one aspect the present invention is a plastic container for retaining a commodity during a high temperature pasteurization or retort process. The container includes a finish defining an aperture for receiving the commodity, a body portion generally extending downward from the finish portion, and a base portion generally extending inward from the body portion and closing off the bottom of the container. The body portion itself has a crystallinity of greater than 30% and a shoulder portion flaring outward, from a generally transverse plane defined by the mouth of the container at an angle greater than 15° or less.

In another aspect, the present invention is a method of forming a plastic container comprising the steps of: providing a preform having a finish within a mold; expanding the preform into conformity with a cavity of the mold to form a container having a body portion with a shoulder and a sidewall; stretching material forming the shoulder at an angle substantially restricting that portion of the material defining a transition from oriented to unoriented material to the finish and to induce orientation into the shoulder adjacent to the finish; thermally treating the container to crystallize the body portion; the orientation being induced in an amount sufficient to prevent opacifying of the material in the shoulder when the container is subjected to temperatures crystallizing the body portion to a crystallinity of greater than 30%.

In yet another aspect, the present invention is a method of forming a plastic container comprising: providing a preform having a finish with a support ring within a mold; expanding the preform into conformity with a cavity of the mold to form a container having a body portion with a shoulder and a sidewall; stretching material forming the shoulder at an angle relative to a transverse plane defined by the mouth of the container to induce orientation into the shoulder adjacent to the finish; heat treating the container to induce in the body portion crystallinity of at least 30%; the orientation being induced in the shoulder being sufficient to prevent opacifying of the material in the shoulder when the container is heat treated to induce in the shoulder crystallinity of at least 30%.

Further features and advantages of the invention will become apparent from the following discussion and accompanying drawings.

DETAILED DESCRIPTION OF THE PREFERRED EMBODIMENT

The following description of the preferred embodiment is merely exemplary in nature, and is in no way intended to limit the invention or its application or uses.

Figure 1:
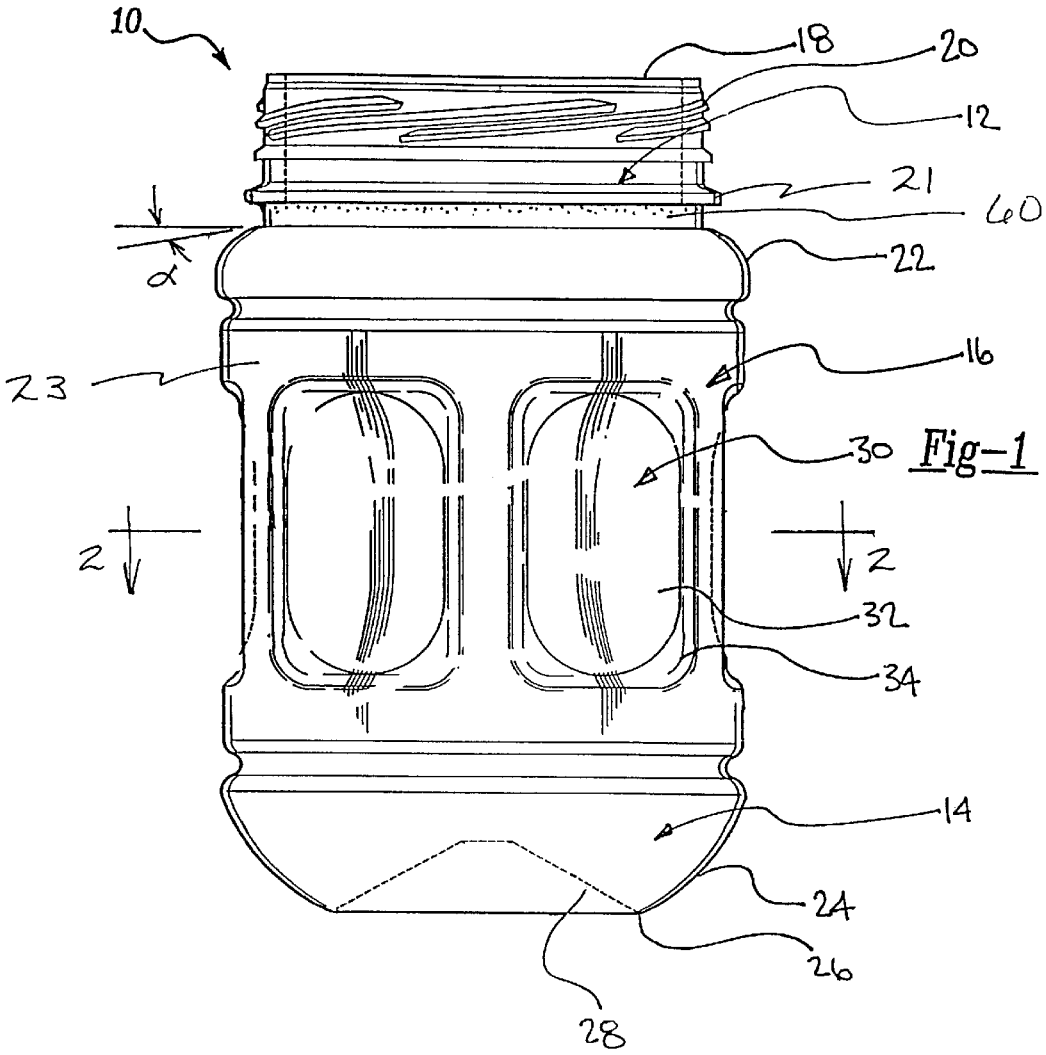
FIG. 1 is an elevation view of the plastic container according to the present invention.

As shown in FIG. 1, the plastic container 10 of the invention includes a finish 12, a base portion 14, and a body portion 16. The finish 12 of the plastic container 10 includes portions defining an aperture or mouth 18, a threaded region 20, and a support ring 21. The aperture 18 allows the plastic container 10 to receive a commodity while the threaded region 20 provides a means for attachment of a similarly threaded closure or cap (not shown), which preferably provides a hermetical seal for the plastic container 10. The support ring 21 may be used to carry or orient the preform (the precursor to the container 10) through and at various stages of manufacture. For example, the preform may be carried by the support ring 21, the support ring 21 may be used to aid in positioning the preform in the mold, or the support ring may be used by an end consumer to carry the container 10.

The base portion 14 of the plastic container 10, which generally extends inward from the body portion 16, includes a chime 24, contact ring 26 and an inwardly recessed region 28. The base portion 14 functions to close off the bottom of the container 10 and, together with the finish 12 and the body portion 16, to retain the commodity.

In the preferred embodiment of the invention, the body portion 16, which generally extends downward from the finish 12 to the base portion 14, includes a shoulder region 22 providing a transition between the finish 12 and a sidewall 23. The sidewall 23 includes several panels 30 that are equally spaced around the sidewall 23. Each of the panels 30 may includes a pressure-panel portion 32 and a vacuum panel portion 34. The pressure-panel portion 32 and the vacuum panel portion 34 function and cooperate to control and limit deformation of the sidewall 23 during the high temperature pasteurization or retort processing of the commodities within the plastic container 10 and during subsequent cooling of the commodities. More specific information regarding the pressure-panel portion 32 and the vacuum panel portion 34 of the panels 30 can be found in U.S. application Ser. No. 09/293,069, Filed Apr. 16, 1999, assigned to the same Assignee as the present invention, which is hereby incorporated in its entirety by this reference.

The plastic container 10 is a blow molded, biaxially oriented container with a unitary construction from a single or multi-layer of plastic material such as polyethylene terephthalate (PET) resin. Alternatively, the plastic container 10 may be formed by other methods and from other conventional materials. Plastic containers blow-molded with a unitary construction from PET materials are known and used in the art of plastic containers and their general manufacture in the present invention will be readily understood by a person of ordinary skill in the art.

Figure 2:
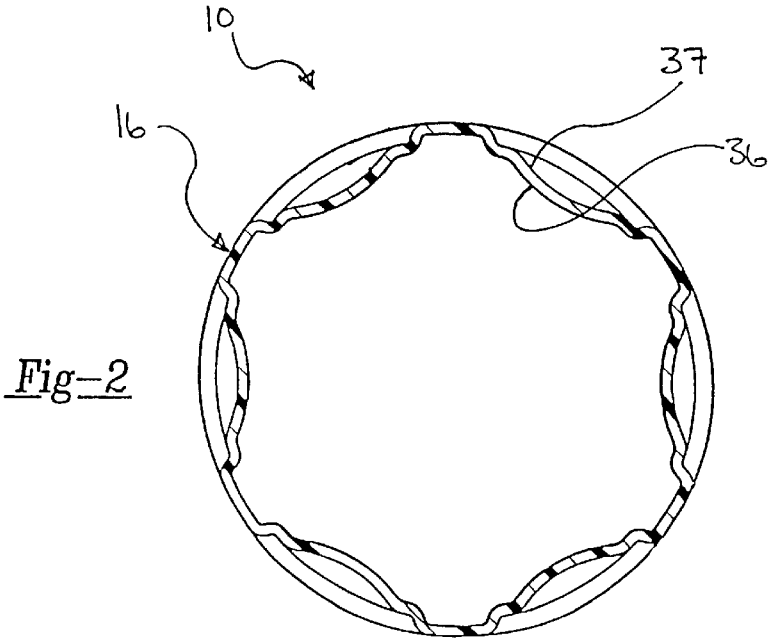
FIG. 2 is a cross-sectional view of the plastic container, taken generally along the line 2—2 of FIG. 1.

The plastic container 10 is preferably heat set with a fluid cycle process. The fluid cycle process includes introducing and/or circulating a high-temperature fluid over an interior surface 36 of the sidewall 16, as shown in FIG. 2. The high-temperature fluid is circulated over the interior surface 36 for a sufficient duration to allow the interior surface 36 to reach a temperature of at least 150° C. (30° F.). The actual duration depends on the composition, temperature, and pressure of the high-temperature fluid, and the flow rate of the high-temperature fluid over the interior surface 36. In the preferred method, the high-temperature fluid is at a temperature of at least 200° C. (418° F.), and at a pressure of at least 1000 kPa (150 psi). Although the preferred composition of the high-temperature fluid is air, other fluids such as steam may be used, as well as higher temperatures and pressures. At the preferred values, the high-temperature fluid is circulated over the interior surface 36 for 1 to 15 seconds, in order to transfer the necessary heat energy to induce the appropriate amount of crystallinity into the plastic container 10. More specific information regarding this fluid cycle process can be found in U.S. application Ser. No. 09/395,708, Filed Sep. 14, 1999, assigned to the same Assignee as the present invention and which is incorporated in its entirety by this reference.

By using the fluid cycle process, the plastic container 10 is produced having a body portion 16 with a crystallinity of greater than 30%. As used herein, crystallinities greater than 30% are considered "high crystallinities". Such high crystallinities allow the plastic container 10 to maintain its material integrity during a pasteurization or retort process of the commodities in the plastic container 10, and during subsequent shipment of the plastic container 10. Other crystallinities have also been induced via the above fluidic processes including a crystallinity of 34.4%, generally corresponding to a density of 1.375 g/cc (measured via a density gradient tube). Other densities greater than 1.375 g/cc, including 1.38 g/cc (roughly corresponding to 38.5% crystallinity), 1.385 g/cc (roughly corresponding to 42.6% crystallinity), and even 1.39 g/cc (roughly corresponding to 46.7% crystallinity) are possible with the fluid cycle process, without significantly impacting the visually perceptible transparency or clarity of the plastic container 10.

Figure 3:
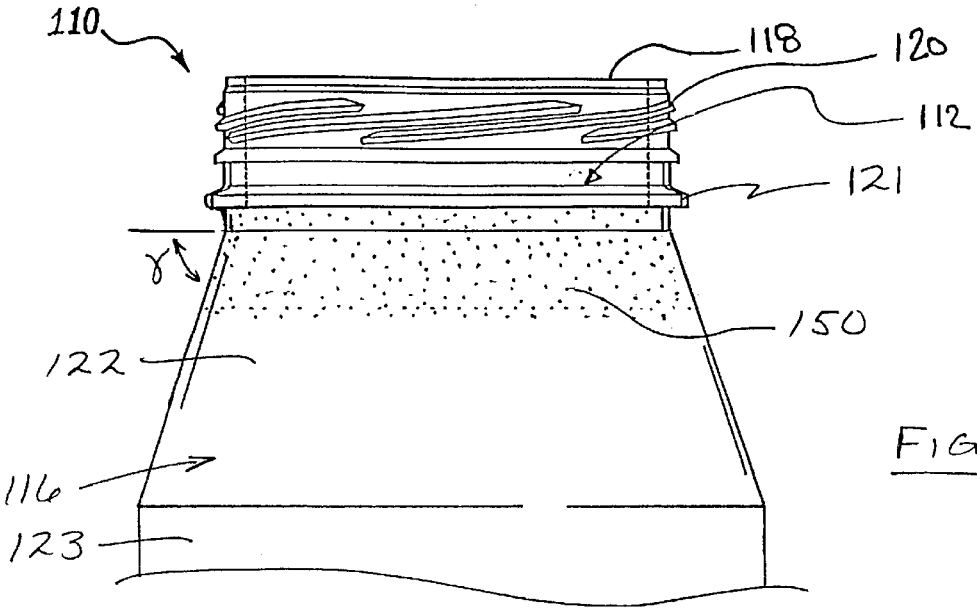
FIG. 3 is a cross-sectional view of a plastic container having a opacified ring of material in its shoulder region.
Figure 4:
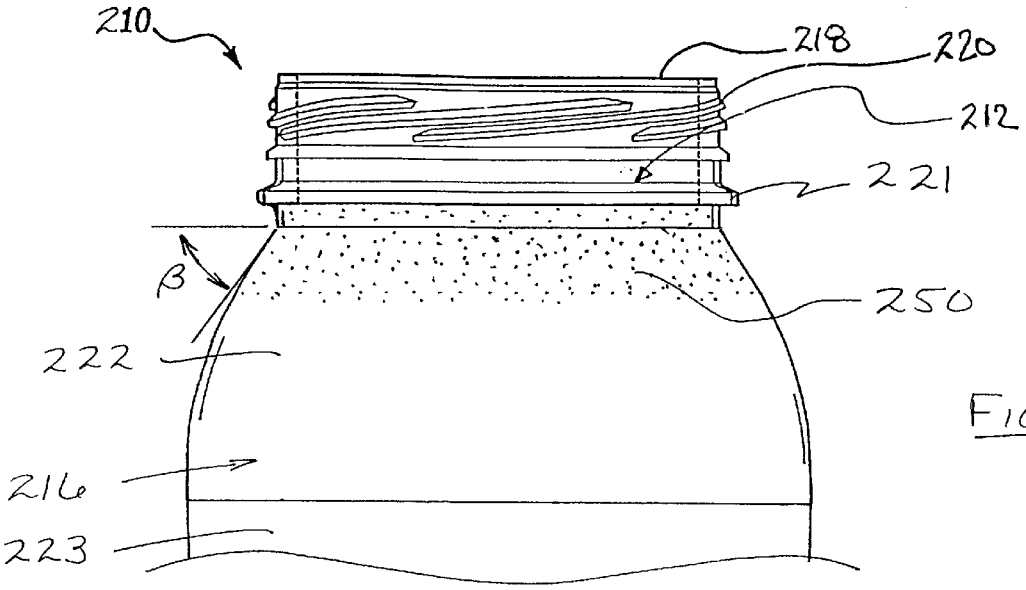
FIG. 4 is a cross-sectional view of another a plastic container having a opacified ring of material in its shoulder region.

When initial prototype containers were heat treated according to the above fluidic process, it was found that while acceptable characteristics were imparted to the body portion, an aesthetically unacceptable opaque band or ring was formed in the shoulder of those containers. Such containers are illustrated in FIGS. 3 and 4 where the containers are designated as containers 110 and, 210. Additional elements of the containers 110 and 210 have been given designation numbers corresponding to the like elements of the container 10 of FIG. 1, except that a 100 or 200 series number designation has been used. As seen in FIGS. 3 and 4, the opacified bands, respectively identified as 150 and 250, form in the shoulders 122 and 222 below and adjacent to the support rings 121 and 221 in the finish 112 and 212.

The formation of these bands 150 and 250 during high temperature pasteurization and retort processes can be eliminated by altering the geometry of the shoulder 22 to induce an abrupt stretching in this region during formation of the container 10. As seen in FIG. 1, at a point in the finish 12 below the support ring 21, where the shoulder 22 begins to flare outward, the flaring proceeds initially at a sharp angle relative to a generally transverse plane defined by the support ring 21 and/or mouth 18 of the finish 12. The introduction of a sharp angle into the molding of the container 10 is contrary bottle blow molding theory which dictates that sharp corners are avoided. Preferably, the shoulder 22 initially flares at an angle $\alpha$ of 15° of less, more preferably at an angle of 10° or less, still more preferably at an angle of about zero. The angles $\gamma$ and $\beta$ for the shoulders 150 and 250 are seen to be greater than 15°.

As a result of this drastic geometry, the transition from unoriented to oriented material is restricted and confined to the material at or immediately below the supporting ring 21. During subsequent thermal processing to induce high crystallinity into the body portion (or subsequent temperature pasteurization and retort processes), the immediate onset of the transition to orientation of the material is sufficient to eliminate or substantially prevent the appearance of an opaque band in the shoulder 22. Rather, any whitening or opacifying that does occur is limited to the short axial segment 60 between the shoulder 22 and the contact ring 21, as seen in FIG. 1.

As used herein, opaque and opacified are intended to mean that such material cannot be visually looked through. Opaque and opacified material is therefore being differentiated from transparent, clear and hazed materials, all of which can be visually looked through.

The foregoing discussion discloses and describes a preferred embodiment of the present invention. One skilled in the art will readily recognize from such discussion, and from the accompanying drawings and claims, that changes and modifications can be made to the invention without departing from the true spirit and fair scope of the invention as defined in the following claims.

We claim:

1. A method of forming a plastic container comprising:

providing a preform having a finish with a support ring within a mold;

expanding the preform into conformity with a cavity of the mold to form a container having a body portion with a shoulder and a sidewall;

stretching material at an angle to form the shoulder, thereby substantially restricting a portion of that material defining a transition from unoriented to oriented material and inducing orientation into the shoulder adjacent to said finish and below the support ring, said orientation being induced in an amount sufficient to prevent opacifying of the material in the shoulder when the container is subjected to heat treating the container to induce in the body portion crystallinity of at least 30%; and heat treating the container to induce in the body portion crystallinity of at least 30%.

2. The method of claim 1 wherein said step of heat treating induces in the body portion crystallinity of at least 34%.

3. The method of claim 1 wherein said stretching step includes initially flaring said shoulder outward from a generally transverse plane defined by a mouth of the preform at an angle of about 15° or less.

4. The method of claim 1 wherein said stretching step includes initially flaring said shoulder outward from a generally transverse plane defined by a mouth of the preform at an angle of about 10° or less.

5. The method of claim 1 wherein said stretching step includes initially flaring said shoulder outward from a generally transverse plane defined by a mouth of the preform at an angle of about zero.

6. A method of forming a plastic container comprising:

providing a preform having a finish with a support ring within a mold;

expanding the preform into conformity with a cavity of the mold to form a container having a body portion with a shoulder and a sidewall;

stretching material at an angle to form the shoulder, thereby substantially restricting a portion of that material defining a transition from unoriented to oriented material and inducing orientation into the shoulder adjacent to the finish, said orientation being induced in an amount sufficient to prevent opacifying of the material in the shoulder when the container is subjected to heat treating to induce crystallinity in the body portion of at least 30%;

heat treating the container to induce in the sidewall crystallinity of at least 30%; and subjecting the container to temperatures greater than 79° C. (175° F.) for a time period of greater than 20 minutes.

7. The method of claim 6 wherein said step of heat treating the container induces in the body portion crystallinity of at least 34%.

8. The method of claim 6 wherein said stretching step includes initially flaring the shoulder outward from a generally horizontal plane defined by a mouth of the container at an angle of about 15° or less.

9. The method of claim 6 wherein said stretching step includes initially flaring the shoulder outward from a generally transverse plane defined by a mouth of the container at an angle of about 10° or less.

10. The method of claim 6 wherein said stretching step includes initially flaring the shoulder outward from a generally transverse plane defined by a mouth of the container at an angle of about zero.

11. The method of claim 6 wherein the container is subjected to temperatures greater than 82° C. (180° F.) for a time period of greater than 20 minutes.

12. The method of claim 6 wherein the container is subjected to temperatures greater than 82° C. (180° F.) for a time period of greater than 30 minutes.

13. The method of claim 6 wherein the container is subjected to temperatures greater than 104° C. (220° F.) for a time period of greater than 20 minutes.

14. The method of claim 6 further comprising the step of crystallizing the finish.

* * * * *